US005487965A

United States Patent [19]

Odell

[11] Patent Number: 5,487,965

[45] Date of Patent: Jan. 30, 1996

[54] PROCESSES FOR THE PREPARATION OF DEVELOPER COMPOSITIONS

[75] Inventor: Peter G. Odell, Mississauga, Canada

[73] Assignee: Xerox Corporation, Stamford, Conn.

[21] Appl. No.: 300,548

[22] Filed: Sep. 6, 1994

[51] Int. Cl.[6] ..... G03G 9/125

[52] U.S. Cl. ..... 430/137; 430/114

[58] Field of Search ..... 430/106, 109, 430/112, 137, 114

[56] References Cited

U.S. PATENT DOCUMENTS

| | | | |
|---|---|---|---|
| 4,783,389 | 11/1988 | Trout et al. | 430/137 |
| 4,917,986 | 4/1990 | Chan et al. | 430/115 |
| 4,960,667 | 10/1990 | Wong et al. | 430/114 |
| 5,053,306 | 10/1991 | El-Sayed et al. | 430/137 |
| 5,123,962 | 6/1992 | Komuro et al. | 106/163.1 |
| 5,168,022 | 12/1992 | Wasmund et al. | 430/58 |
| 5,270,359 | 12/1993 | Romangosa et al. | 430/109 |

*Primary Examiner*—John Goodrow
*Attorney, Agent, or Firm*—john L. Haack

[57] ABSTRACT

A process for preparing a liquid developer composition comprising: a) forming a melt mixture comprised of a polymer resin or resins, a colorant, a charge director additive, and a hydrocarbon liquid carrier, to obtain a first suspension of colored polymeric particles with an area average diameter of from about 2 to about 100 microns; b) dispersing said first suspension in a supercritical fluid medium and thereafter continuously feeding the resultant dispersion to a liquid fluidizing means under pressure to obtain a second suspension comprising a supercritical fluid and liquid developer mixture containing colored polymeric particles with an area average diameter of from about 0.1 to about 10 microns; and c) reducing the pressure to evaporate, and optionally recovering, the supercritical fluid medium from said second suspension, wherein there results a liquid developer mixture containing colored polymeric particles with an area average diameter of less than about 3.0 microns and a solids content of about 10 to about 90 weight percent.

28 Claims, 2 Drawing Sheets

PROCESSES FOR THE PREPARATION OF DEVELOPER COMPOSITIONS

CROSS REFERENCE TO COPENDING APPLICATIONS AND PATENTS

Reference is made to U.S. Pat. No. 5,274,057, issued Dec. 28, 1994, entitled "Bead Suspension Polymerization Process", and copending application numbers U.S. Ser. No. 07/065,414, filed May 24, 1993, entitled "Liquid Developer Compositions", and U.S. Ser. No. 08/098,150, filed Jul. 28, 1993, entitled "PROCESSES FOR THE PREPARATION OF DEVELOPER COMPOSITIONS", the disclosures of which are incorporated by reference herein in their entirety.

BACKGROUND OF THE INVENTION

This invention is generally directed to processes for the preparation of liquid and dry toners, and more specifically to processes employing a supercritical fluid, such as carbon dioxide, for the preparation of developer compositions containing small polymeric particles, for example, in embodiments, with an average diameter of from about about 0.1 micron to about 5 microns. More specifically, the present invention is directed to economic processes for the preparation of micron and submicron size polymeric particles, useful as liquid and dry electrophotographic developer compositions which processes comprise, in embodiments, forming a melt mixture comprised of a polymer resin or resins, a colorant, a charge director additive, and a hydrocarbon liquid carrier, to obtain a first suspension of colored polymeric particles with an area average diameter of from about 2 to about 100 microns; dispersing said first suspension in a supercritical fluid medium and thereafter continuously feeding the resultant dispersion to a liquid fluidizing means at a pressure of from about 800 to about 4,000 pounds per square inch to obtain a second suspension comprising supercritical fluid and liquid developer mixture containing colored polymeric particles with an area average diameter, in embodiments, of less than about about 2.0 microns and a solids content of about 10 to about 90 weight percent; and reducing the pressure to ambient levels to evaporate, and optionally recovering the supercritical fluid medium from the second suspension, wherein there results a liquid developer mixture containing colored polymeric particles with an area average diameter of less than about about 2.0 microns and a solids content of about 10 to about 90 weight percent is obtained, for example. As indicated herein, the finely divided polymer particles obtained with the process of the present invention can, for example, be selected as liquid and dry electrophotographic developer compositions.

The formation of small polymeric particles for use in liquid and dry electrophotographic developer compositions by particle size reduction or comminution of larger particles has been generally accomplished by, for example, milling or grinding processes for extended periods of time wherein polymer particles suspended in a non-dissolving liquid are milled with optional heating to form particles having reduced particle size properties. With these processes, it has been difficult to achieve low cost, clean, that is for example with no, or substantially no, impurities from the milling media or apparatus on the surface of the resulting particles, and/or dry particles of small particle size. The particles formed by milling or grinding processes are generally larger than 2.0 micrometers thus they are not suitable as liquid and dry electrophotographic developer compositions, particularly for high quality color printing applications unless lengthy attrition times, generally exceeding 6 hours, are used to obtain particles on the order of 2 microns volume average diameter. Thus grinding or attrition, especially fluid energy milling, of large particles to the size needed for liquid and dry developer compositions, that is for example from about 0.1 to about 5 microns volume average diameter, is often not desirable both from an economic and functional viewpoint. Further, processes such as spray drying of polymers suspended in solvent can result in polymer particles with particle sizes much larger than about one micron and possessing a broad size distribution range including fibers and strands of filamented resins, as well as trapping of solvent which interferes with the viability of the particles as developers. Moreover, solvent recovery in these processes is considered very costly.

Trout et al, in U.S. Pat. No. 4,783,389, issued Nov. 8, 1988 disclose a process for the preparation of toner particles for liquid electrostatic imaging comprising: (a) mixing a thermoplastic resin and a nonpolar liquid at a temperature sufficient to plasticize and liquify the resin and below that at which the non-polar liquid boils and the resin decomposes; (b) cooling the mixture to form resin particles in the nonpolar liquid; and (c) reducing the size of the resin particles to below about 30 micrometers by passing the product of step (b) through at least one liquid jet interaction chamber at a liquid pressure of at least 1,000 psi (68 Bars), for example, using a MICRCOFLUIDIZER® from Microfluidics Corporation. The process produces liquid electrostatic developer useful in copying, making proofs, including digital proofs, and the like. The MICROFLUIDIZER® method suffers from several disadvantages including frequent and recurring jet nozzle clogging with particles greater than 50 microns in diameter. Moreover, resin filaments and large particles are formed at operating pressures of greater than about 500 Bars. Thus, at typical Microfluidizer® processing pressures recommended by Trout et al, polymer suspensions in nonaqueous solvents tend to destabilize and lead to agglomerated particles that are not suitable for liquid or dry electrophotographic developers.

Komuro et al, in U.S. Pat. No. 5,123,962, issued Jun. 23, 1992, disclose a suspension comprising a dispersing medium containing at least 2% by weight of a fine particle cellulose material having a 50% cumulative volume diameter of from 0.3 to 6.0 micrometers. The suspension is obtained by a process comprising subjecting a cellulosic material to a depolymerization pretreatment, followed by wet grinding in a container containing a grinding medium and equipped with a rotary blade for forced stirring of the medium. The suspension has excellent viscosity, water retention properties, stability, and palatability.

El-Sayed et al, in U.S. Pat. No. 5,053,306, issued Oct. 1, 1991, disclose a process for the preparation of toner particles for electrostatic liquid developers comprising: (a) dispersing at ambient temperatures a colorant, an A-B diblock copolymer grinding aid, and a carrier liquid; (b) adding to the dispersion a thermoplastic resin and dispersing at an elevated temperature to plasticize and liquify the resin; (c) cooling the dispersion while grinding with particulate media; (d) separating a dispersion of toner particles having an average by area particle size less than 10 micrometers, from the particulate grinding media; and (e) adding during or subsequent to step (b) at least one ionic or zwitterionic charge director compound. Steps (a) and (b) can be combined by adding the thermoplastic resin to the other ingredients and dispersing at an elevated temperature. The liquid developers are useful in,copying, in making color proofs, and the like.

Wasmund et al, in U.S. Pat. No. 5,168,022, issued Dec. 1, 1992, disclose a process for preparing a photoconductive pigment having a small particle size, a polymorph of a pigment is produced by a conversion process wherein a seed amount of the desired polymorph of the pigment and a larger amount of another polymorph of the pigment are subjected to a liquid jet interaction process.

Wong et al, in U.S. Pat. No. 4,960,667, issued Oct. 2, 1992 disclose a positively charged liquid developer composition comprised of resin particles, a hydrocarbon, laked carbon black particles, and a charge director wherein the composition is prepared in a shot mill attritor with steel balls.

Chan et al, in U.S. Pat. No. 4,917,986, issued Apr. 17, 1990, disclose a positive, liquid electrostatic developer consisting essentially of (a) a nonpolar liquid having a Kauri-butanol value of less than 30, present in a major amount, (b) thermoplastic resin particles having dispersed therein a phosphorous containing compound defined therein which is substantially insoluble or immiscible in the nonpolar liquid at ambient temperatures, the resin particles having an average by area particle size of less than 10 microns, and (c) a nonpolar liquid soluble ionic or zwitterionic charge director compound, and a process for preparation. The preparation process comprises (a) dispersing the resin, the phosphorous compound at elevated temperature, (b) cooling with or without stirring or while grinding, (c) separating the dispersion of toner particles from the particulate media, and (d) adding to the dispersion during or subsequent to step (a) a nonpolar liquid soluble ionic or zwitterionic charge director compound.

The use of supercritical fluids (SCF) in materials and chemical processing systems is known, for example, for forming homogeneous polymer blends in U.S. Pat. No. 5,290,827; depositing thin films in U.S. Pat. No. 4,737,384; organic synthetic reaction solvent media in U.S. Pat. No. 5,241,048; polycarbonate polymer purification in U.S. Pat. No. 4,918,160; and enhanced liquid extraction in U.S. Pat. No. 4,547,292.

Other references of interest include: U.S. Pat. Nos. 4,476,210 and 4,816,370 to Croucher et al., which disclose liquid developers and methods for making; and U.S. Pat. No. 5,306,590 to Fendler which discloses high solids liquid developer concentrates.

The aforementioned Trout et al., U.S. Pat. No. 4,783,389, which utilizes a MICROFLUIDIZER® device to achieve particle size reduction relies upon two principle mechanisms: particle-particle collisions between opposing liquid streams and cavitation. Using a MICROFLUIDIZER® device in a conventional manner for the preparation of liquid dispersions of very fine particles as described by Trout et al., has several inherent complications and operational limitations, including, for example: 1) a requirement that the feed solution to be fluidized be hot, at a temperature of about 80 to about 100° C., and the initial particle size be less than about 50 micrometers; 2) the MICROFLUIDIZER® device is energy intensive requiring an air compressor to attain supersonic high pressures; 3) the device is operationally man power intensive in that it has various valving and orifices which can potentially readily clog and require regular dissembly and tedious cleaning thereby limiting potential for continuous operation; and 4) the device produces liquid ink developer formulations that tend to be unstable and have limited storage shelf-life in that the formulations may undergo catastrophic formulation failure on standing at room temperature as manifested by a congealing of the suspended resin particles into large monolithic solid masses which are difficult or nearly impossible to redisperse without resorting to high energy means. Moreover, resin filaments and large particles are formed at operating pressures greater than 500 Bars in the absence of a supercritical fluid, which pressures are typical of MICROFLUIDIZER® processing/operating pressures.

Use of the aforementioned shot mill attritor technique for achieving resin in hydrocarbon formulation dispersion and particle size reduction of less than about 10 microns average diameter as, for example, in Wong U.S. Pat. No. 4,960,667, typically a very energy and time intensive process and noisy unit operation, results in metal contamination from the steel balls which may require an additional magnetic filtration step. The shot mill has a rather limited operational void volume where the formula is processed, even for very large attritors, thereby prohibiting rapid and continuous large scale production.

There thus remains a need for an economic and convenient process of obtaining very small polymeric particles, and more specifically micron and submicron polymeric particles, without the complications and disadvantages of the aforementioned prior art devices and processes. Further, there is a need for particle size reduction or comminution processes for obtaining clean, optionally dry and small polymeric particles, for example, from about 0.1 to about 5 microns and preferably less than about 2.0 microns in volume average diameter as determined by a scanning electron microscope or a Horiba Capa-700 particle size distribution analyzer. Still further, there is a need for heterogenous or non-dissolving particle size reduction processes that permit low cost, clean, and optionally dry, or nonaqueous, micron and submicron polymeric particles that can be selected as liquid and dry electrophotographic developer compositions, carrier powder coatings, photoconductor pigment-resin coating suspensions, and as toner additives for enhanced photoreceptor cleaning. Another need is the ability to directly produce high solids resin particle suspensions for use as liquid developers and the like liquid formulations without the need for an intermediate concentration step.

SUMMARY OF THE INVENTION

An object of the present invention is to provide processes for preparing finely divided polymeric particles with many of the advantages illustrated herein.

In another object of the present invention there are provided simple processes for the formation of small polymeric particles, and more specifically submicron size polymeric particles.

Yet, in another object of the present invention there are provided simple and economical processes for the formation of finely divided polymeric particles, and more specifically submicron size polymeric particles.

Another object of the present invention resides in the provision of simple and economical processes for the preparation of low cost, clean, that is substantially no impurities, and well defined size distribution polymeric particles, especially polymeric particles for liquid and dry electrophotographic developer compositions.

Another object of the present invention resides in providing simple and economical substantially non-dissolving dispersion comminution processes for the preparation of low cost, clean, and well defined particle size distribution small polymeric particles, and more specifically submicron size polymeric particles useful for liquid or dry electrophotographic developers.

Further, another object of the present invention resides in simple and economical processes for producing a low cost, clean and well defined particle size distribution of polymeric particles especially polymeric particles useful as toner additives and photoreceptor additives.

Additionally, in another object of the present invention there are provided, as a result of the enhanced degree of control and flexibility, processes for the preparation of finely divided Polymeric particles with improved liquid and powder flow, image fusing and self annealing properties.

In still yet another object of the present invention is provided processes that enable the direct production of high solids resin particle dispersions for use as dry and liquid developers and which developers can be prepared without the need for an intermediate liquid concentration step.

These and other objects of the present invention are accomplished by the provision of processes for the preparation of polymer particles, referred to herein as dispersion-comminution processes, in which a mixture of a polymer resin or resins, a colorant or pigment, a charge director such as a block copolymer quaternary ammonium salt, and a non aqueous solvent are dispersed, optionally with high shear, optionally heated to provide a melt mixture, thereby forming a first suspension of colored polymeric particles with a volume average diameter of from about 2 to about 100 microns; dispersing said suspension in a supercritical or near supercritical fluid medium and thereafter continuously feeding the resultant dispersion to a liquid fluidizing means at a pressure of from about 800 to about 4,000 pounds per square inch to obtain a second suspension comprising a supercritical fluid and liquid developer mixture containing colored polymeric particles with a volume average diameter of from about 0.1 to about 10 microns and a solids content of about 10 to about 90 weight percent; and reducing The pressure to ambient levels to evaporate, and optionally recovering the supercritical fluid medium, wherein a liquid developer mixture containing colored polymeric particles with an area average diameter of less than about about 2.0 microns and a solids content of about 10 to about 90 weight percent is obtained, and optionally isolating the finely divided polymeric particles.

One important specific embodiment of the present invention comprises the preparation of colored polymeric particles, which comprises the dispersion of thermoplastic polymers, a colorant or pigment, and charge control adjuvant or director, a non-dissolving hydrocarbon liquid in a supercritical or near supercritical medium, such as carbon dioxide, to a achieve uniform particle size reduction thereby rendering the resulting formulation suitable for use as a liquid developer after removal and recovery of the supercritical medium. Alternatively, the liquid hydrocarbon medium may be removed to provide colored polymeric particles suitable for use as a dry developer or a liquid developer concentrate.

Another specific embodiment of the present invention comprises a process for preparing liquid ink formulations which is achieved by, for example, combining a hot melt adhesive resin compound, a pigment, a charge director, a hydrocarbon liquid carrier and thereafter forming a melt mixture with heating in, for example, an extruder. The crude ink dispersion mixture as a suspension is then dispersed in a supercritical fluid medium, such as supercritical or near supercritical carbon dioxide, and continuously feeding the mixture to a liquid fluidizing means such as a MICROFLUIDIZER®, or a piston homogenizer.

In an illustrative supercritical fluid medium dispersion step, a liquid developer concentrate comprising a polymer resin, a colorant, a charge additive, and a hydrocarbon liquid carrier with dispersed resin particles of less than about 100 microns, is dispersed further with supercritical carbon dioxide the subjected to liquid stream interactions, for example, liquid-liquid stream type in a MICROFLUIDIZER® and liquid-stationary wall type as in a piston homogenizer, to obtain area average particles of 1.7 microns as determined using the Horiba CAPA-700 upon removal of the supercritical fluid. Other process conditions including embodiments described in the working Examples can be used providing the objectives of the present invention are achieved.

Also, the process of the present invention is directed to the preparation of small polymeric particles, that is with, for example, a volume average particle diameter in the range of from about 0.1 micron to about 2 microns, for polymeric resins having a number ($M_n$) and weight ($M_w$) average molecular weight of from about 5,000 to about 500,000 and from about 10,000 to about 2,000,000, respectively, and preferably 30,000 to about 50,000 weight average molecular weight. A weight average to number average molecular weight ratio or polydispersity of polymer resins useful in the present invention is between 1 and 15.

Further, the process of the present invention is directed to the preparation of polymeric particles of area average diameter of from about 0.1 to about 2.0 microns, and preferably less than 2 microns, with a resin or resins having a number average molecular weight of from about 5,000 to about 50,000 and a weight average molecular weight of from about 10,000 to about 500,000 useful as liquid immersion development inks, carrier coatings, as photoreceptor additives, and as toner additives.

DETAILED DESCRIPTION OF PREFERRED EMBODIMENTS

A supercritical fluid refers, for example, to a material that is above its critical temperature ($T_c$) and critical pressure ($P_c$) which for carbon dioxide is 31.1° C. and 72.8 atm (1,070 psi), respectively. Near supercritical conditions, for example, for $CO_2$ are temperatures between about 25° C. and 31° C. and pressures between about 800 and 1,070 psi the pressure at which $CO_2$ is liquid at room temperature.

In manufacturing practice, the present invention may be conducted in batch or semi-continuous modes on larger scales with, for example, from about 3 to about 5 in-line processing systems in series of the type described herein where individual toner particles are resident for less than a few seconds in any single stage.

Figure 1:
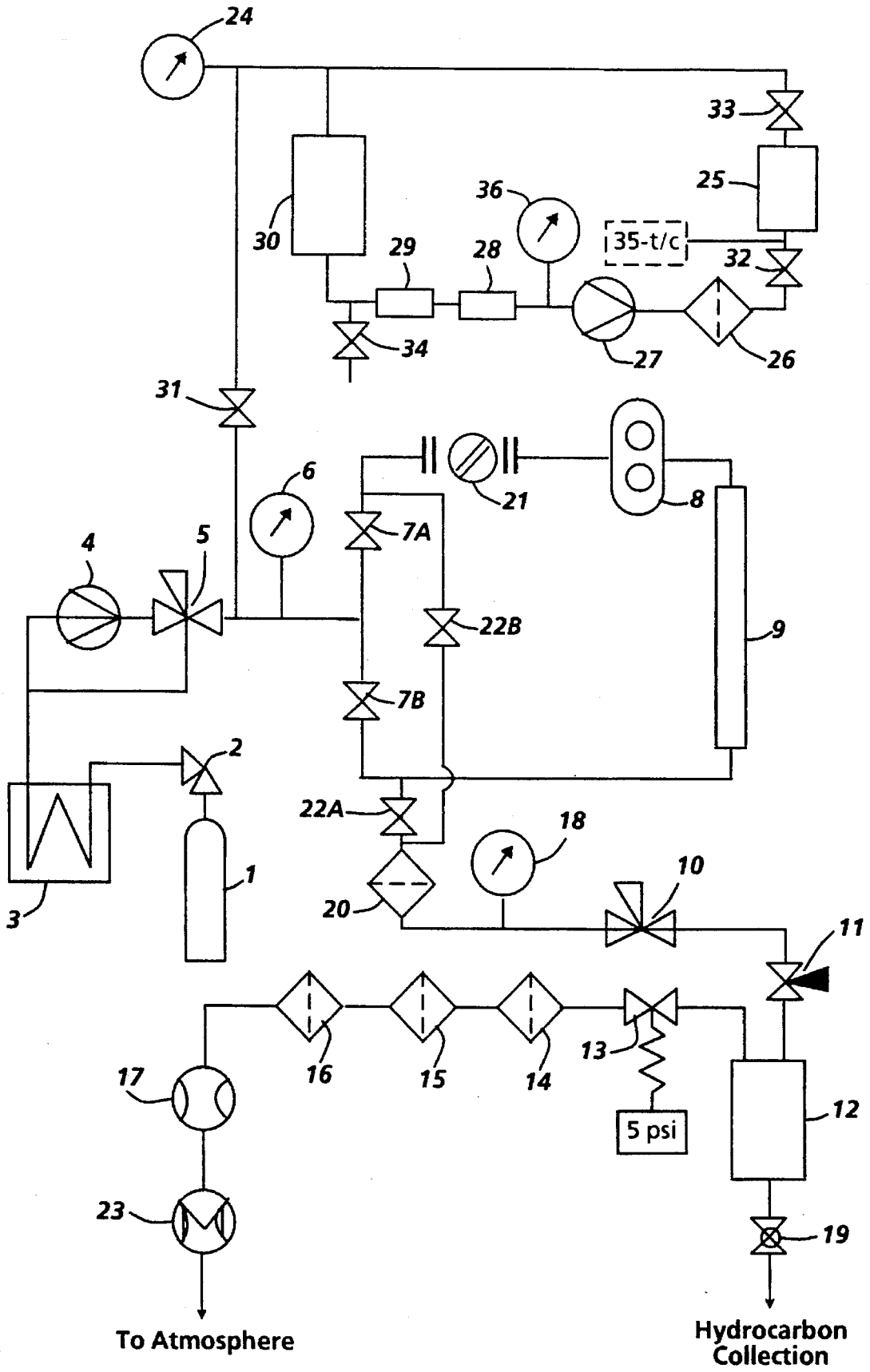
FIG. 1 is an exemplary schematic view of process equipment, stages, and material flow of an embodiment of the present invention.

FIG. 1 is a schematic of the process equipment used in embodiments of the present invention. Two principle components are a Microfluidics 110Y MICROFLUIDIZER® and a Supercritical Fluid Extraction System available from Autoclave Engineers, Inc. of Erie, Pa. Several modifications were made to integrate the two units and to improve the performance of the Autoclave unit. With reference to FIG. 1, the liquid developer preparation process begins with a carbon dioxide source 1 and a pump 4. In an example configuration, a liquid carbon dioxide source 1 is chilled in bath 3. The coolant from this bath may optionally also be used to cool the pump head of the pump 4, for example, a LDC minipump Model 396. The bath coolant is preferably maintained, for example, at −10 to −20° C. The pump employed is preferably a reciprocating piston arrangement that requires cooling in order to avoid vaporization of the $CO_2$ and subsequent cavitation and loss of pumping ability. More sophisticated pumps may be selected such as those employing compressors which do not require the $CO_2$ to be a liquid. Syringe pumps may alternatively be selected as a pump for the supercritical fluid medium. The fluid pressure arising from the pump 4 is controlled by a pressure regulator 5 and monitored by gauge 6. The supercritical fluid then passes via valve 31 to modified a MICROFLUIDIZER® delivered via a 4-way cross piece accommodating fluid supply from pump 4, return line from MICROFLUIDIZER®, pressure gauge and connection to sample cylinder 25. This design can result in particles returning from the MICROFLUIDIZER® to move into the supply line and possibly flooding it. An improved flow pattern eliminates valve 33 and runs the ⅛ inch return from the MICROFLUIDIZER® well into the sample cylinder. Gravity and the; suction of the MICROFLUIDIZER® pump 27 out the bottom of the sample cylinder which greatly reduces the number of particles moving down the supply line through valve 31. Additionally, this arrangement promotes more thorough mixing in the sample chamber 25. A pressure relief valve (not shown) directed to exhaust rather than a rupture disc makes an overpressure event less catastrophic. The sample cylinder may be replaced with any suitable pressure vessel, for example, a stirred 300 mL autoclave from Autoclave Engineering allows the processing fluid to be stirred thereby improving dispersion uniformity. A larger opening in the sample chamber 25 makes loading and unloading developers easier, and a much larger pressure range is available. Whichever processing reservoir is selected, either a sample cylinder or a stirred autoclave, the bottom opening of the reservoir is preferably relatively large to avoid starving the MICROFLUIDIZER® pump. Valve 32 is also optional. An optional large mesh in-line filter screen 26 protects the MICROFLUIDIZER® from large, potentially plugging particles. The pump, interaction chamber 26, back pressure module 29 and all associated plumbing up to the heat exchanger 30 are standard parts of the commercially available 110Y MICROFLUIDIZER®. The heat exchanger 30, in embodiments, is a section of ⅛ inch stainless steel coiled tubing in a metal jacket through which water or other suitable cooling media can be passed to maintain a desired temperature range. Typically, there is a cooling requirement due to the heat build up in the process fluid from the mechanical work of the MICROFLUIDIZER®. In working with supercritical fluids, it may be advantageous to maintain a particular (critical) temperature rather than simply indiscriminate cooling. Recirculated coolant fluid from a heating/cooling bath, such as a Neslab RTE-110, provides this function. After passing through the heat exchanger 30, the process fluid returns to the process reservoir (sample cylinder 25). This system can be brought to operating pressure via pump 4 and then isolated by closing valve 31. However, this isolation eliminates active pressure control and relies entirely on temperature control to prevent excess pressure build up. In the 1,000 to 2,000 psi range, $CO_2$ pressure is very sensitive to slight temperature charges. A preferred alternative is to leave valve 31 open allowing pump 4 and regulating valve 5 to make up any pressure loss; and more importantly, valve 10 is left slightly open to control and release any overpressure that may develop. The flow of overpressure is through valve 31 to either or both pairings of valves 7A and 22B, or 7B and 22A. Thereafter, the fluid passes through an in-line filter 20 that protects downstream components. The pressure is monitored by pressure gauge 18. Loss of synchronous pulsing within the MICROFLUIDIZER® indicates that filter 20 is clogged prior to passing pressure regulating valve 10 and needle valve 11. Both these valves are heated, for example, by electric heating tape, as is the line connecting the two valves. External heating of these components compensates for the cooling effect result from the expansion of carbon dioxide through these valves. The precise temperature is not critical as long as heating is sufficient to prevent the lines and valves from freezing the hydrocarbon or $CO_2$ process stream. The temperature fluctuates proportionately with the rate of $CO_2$ flow. The current to the external heaters is adjusted to keep these components warm to the touch, for example, about 50° to about 60° C. Valve 10 provides most of the control over backpressure and partial control over flow. Valve 11 provides some control over material-flow to prevent exceeding the capacity of the downstream components. Adjustable valves 5 and 10 provide pressure control for the system. Any extracted hydrocarbon precipitates from the carbon dioxide as the pressure drops and is swept into separator vessel 12 where it can be collected via valve 19. Small amounts of hydrocarbon are removed by filters 14 to 16. The $CO_2$ flow is monitored by flow meter 17 and totalizer 23. Little flow occurs to or through the collection and recovery components during the normal operation of the MICROFLUIDIZER®. Upon completion of a complete process cycle, these lines and valving sequence are used to vent the pressure from the system.

Figure 2:
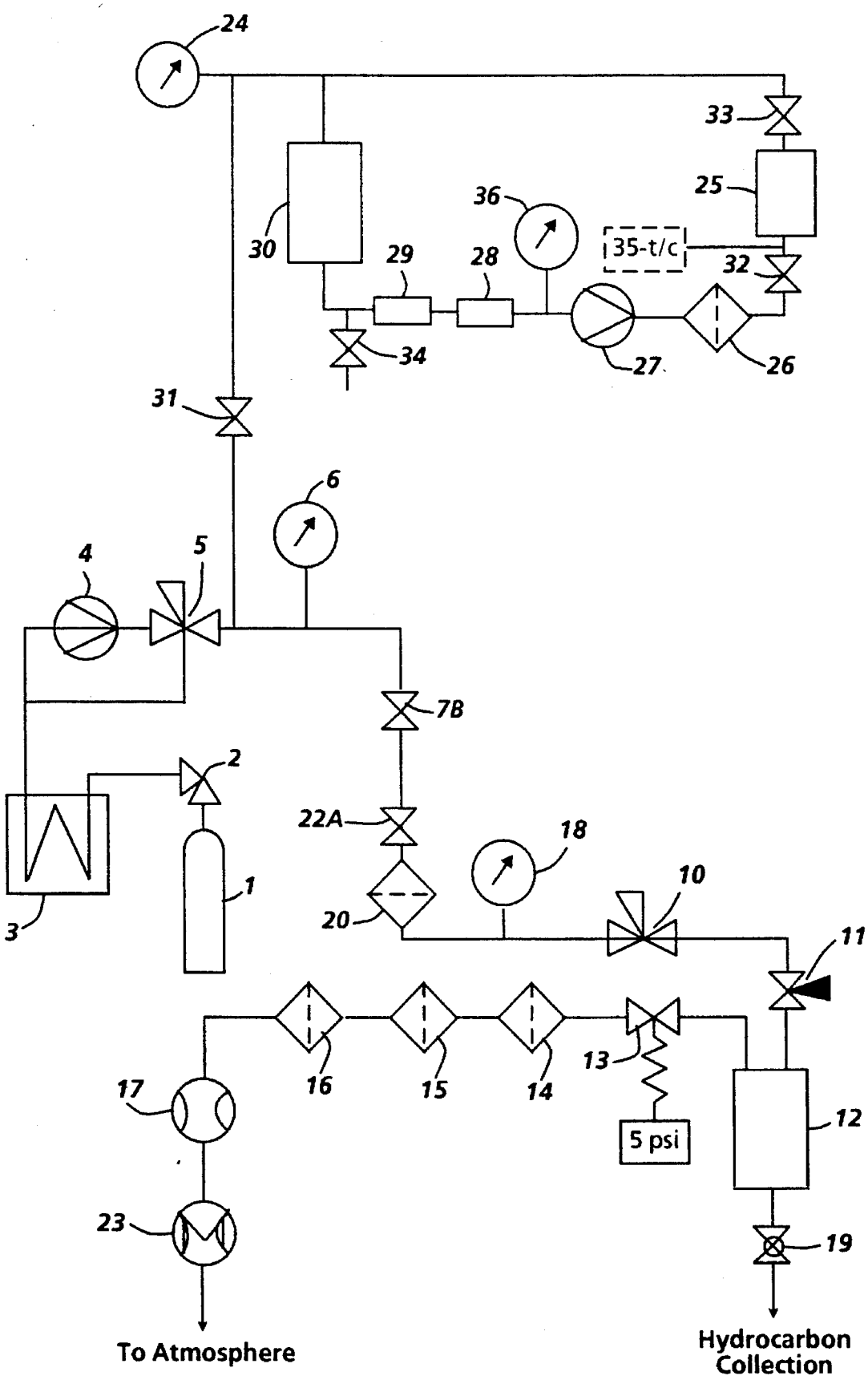
FIG. 2 is a modification of the schematic shown in FIG. 1 wherein an extraction vessel and loop have been eliminated.

In an alternative embodiment, as illustrated in FIG. 2, components 8, 9, 21 and 22B are omitted without comprising the efficacy of the process or the development properties of the resultant liquid developer. For those components not specifically recited herein, the accompanying Table provides a complete component Legend listing for FIG. 1.

A wide variety of operating conditions are available, for example, with a variety of hydrocarbons with limited carbon dioxide solubility, on the order of 2 to 3 percent by volume to above about 50% is achieved with pressure as; above 2,000 psi. It is well known that as a hydrocarbon dissolves in supercritical carbon dioxide it may modify the solvent hydrocarbon solubility thereby increasing the ability of the carbon dioxide to dissolve, in turn, more hydrocarbon. Significant solubility occurs with some hydrocarbons as low as 1,200 psi. The density of the supercritical fluid and its solvating power increases with pressure. However, above about 4,000 psi, very little change in density occurs and thus pressures above 4,000 psi are not usually of practical interest. If desired, one may preserve the ratio of developer dispersant to developer solids and thereby minimize both temperature and pressure changes during processing. The temperature in the extraction vessel is typically about 35° C., whereas below about 31° C. carbon dioxide becomes subcritical. While this does not rule out the extraction process, the possibility of another phase (liquid) forming makes process control more difficult. Temperatures at which the toner particles can agglomerate should be avoided. The temperature at which this practical occurs is about 70° C. so that the operating temperature should be preferably kept below this limit.

The starting material can be any suitable hydrocarbon dispersed toner. For example, the hydrocarbon toner dispersion may be in a liquid suspension form such as found at about 2 to about 15 or 20 percent solids, it may be a paste or slurry like concentration of about 20 to 40 percent solids, or even a powder consistency such as found at concentrations above about 40 weight percent. Liquid suspensions offer the advantage of being easy to load into the extraction vessel, but require larger vessels relative to the output obtained. The feed mixture must contain dispersed particles of a suitable size range of from about 2 to about 100 microns to avoid plugging the small orifices of the MICROFLUIDIZER® interaction chamber, for example, at least less than about 100 microns. Processing to achieve this dispersion may be done in a suitable hydrocarbon with a rotor stator mixer, an attritor, or, for example, continuously precipitating the hot output stream of a mixing device, such as an extruder, into a Continuous Processor available from Teledyne Readco of York, Pa. chilled to less than about 40° C. and preferrably below about 5° C.

The polymeric resin or resins useful in the formulations of the present invention comprise from about 70 to about 98 percent by weight of the solids content of the developer.

Illustrative examples of polymers and copolymer resins include vinyl monomers consisting of ethylene or styrene and derivatives thereof such as styrene, α-methylstyrene, p-chlorostyrene, and the like; monocarboxylic acids and derivatives such as acrylic acid, methacrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, octadecyl methacrylate, acrylonitrile and acrylamide; dicarboxylic acids having a double bond and their derivatives such as maleic acid, monobutyl maleate, dibutylmaleate; vinyl esters such as vinyl chloride, vinyl acetate and vinyl benzoate; vinyl ketones such as vinyl methyl ketone and vinyl ether ketone; vinyl ethyl ether and vinyl isobutyl ether; vinyl naphthalene; unsaturated monoolefins such as isobutylene and the like; vinylidene halides such as vinylidene chloride and the like; N-vinyl compounds such as N-vinyl pyrrole and the like; and mixtures thereof.

The colorant or pigment is present in an amount of, for example, from about 0.1 to about 30, and preferably 20, percent by weight of the solids content of the developer and is selected from the group consisting of cyan, yellow, magenta, red, green, blue, brown, orange and black, such as carbon black or magnetite, pigments or dyes, and mixtures thereof. Examples include REGAL 330® carbon black, MAPICO BLACK®, and the like.

Illustrative examples of charge control agents or charge adjuvants which are believed to function in controlling the sign and the magnitude of the charge on the suspended particles include: fatty acids or fatty acid salts and complex metal salts as a negative charge control agent such as aluminum stearate and derivatives thereof, and aluminum t-butyl salicylate and mixtures thereof, and comprise from about 0.1 to about 15 percent by weight of the solids content of the developer. Among these compounds particularly useful are aluminum stearate and block copolymers containing quaternary ammonium hydrogen halide salt side groups.

Nonaqueous solvent useful in the present invention as a solvent and developer suspending medium are branched or linear aliphatic hydrocarbons, for example, NORPAR 15 and ISOPAR L, H, M and mineral oil and mixtures thereof, having from 10 to 25 carbon atoms and which solvent is present from about 50 to about 98 percent of the total weight of the developer.

In embodiments of the present invention the first formed melt mix suspension comprising resin, pigment or colorant, nonaqueous solvent, and charge director is optionally dispersed with high shear or ball milling to form suspended polymeric particles with a volume average diameter of from about 1 to about 100 microns accomplished over a period of about 1 minute to about 10 minutes.

Dispersion of the hydrocarbon resin suspension in a supercritical fluid medium is accomplished by sealing the suspension in a pressure vessel and applying $CO_2$ pressure and optionally stirring by known mechanical or magnetic means. Alternatively, dispersion may be accomplished over time and due to the agitation of the pumping device. Liquid fluidizing means include, for example, a piston homogenizer, for example, the Union Homogenizer Model HTD28 available from the Union Pump Company. The piston homogenizer is comprised of a high pressure pump which is an electrically driven compression engine which in stage one compresses the fluid and particulates, and in stage two impinges the mixture onto a homogenizer valve. The high pressure pump must be modified accordingly to accommodate the high pressure carbon dioxide feed.

Using the aforementioned two step processing of the piston homogenizer provides for mixing followed by subsequent particle size reduction in a single pass of the process stream through the system thereby minimizing material handling and eliminating recirculation of material. However, one step piston homogenization processing also provides formulations which are useful and suitable as liquid and dry inks. In the one-step processing, the feed ink is passed directly through the piston homogenizer. Two-step processing is comprised of first thermal equilibration and fluidization, then second, particle impingement and mechanical comminution.

Particle size reduction apparatuses suitable for use in the dispersion comminution step of the present invention are, for example, a MICROFLUIDIZER® from Microfluidics as described above; and a piston homogenizer device comprising: (a) means for introducing the first suspension into the homogenizer and means for removing the resulting second suspension from the homogenizer; (b) a nozzle for ejecting the first suspension at high pressure; and (c) a flat plate or wall whereby particle collisions, cavitation, and/or shear of the suspended particles contained in the suspending media occur under high pressure emanating from said nozzle resulting in ultra high shear forces and fractures of the suspended polymeric providing particles of the desired size domain and range of from about 0.1 micrometers to about 5 micrometers volume average diameter.

The pressure employed in the aforementioned dispersion comminution step is typically from about 500 to about 5,000 psi and preferably 800 to 4,000 psi.

The pigmented polymeric particles obtained by the processes of the present invention in embodiments have an area average particle diameter of from about 1.0 micron to about 2.5 microns as measured by, for example, an Horiba CAPA-700 particle size distribution analyzer.

The pigmented polymeric particles may be optionally isolated, for example, by evaporation of the hydrocarbon carrier liquid, and subjected to washing and drying using known materials and methods when dry particles are desired. Isolation of the finely divided pigmented particles formed in the dispersion comminution step can be achieved by any known separation technique such as filtration, centrifugation, and the like. Classical drying techniques such as vacuum drying, freeze drying, spray drying, fluid bed drying, and the like, can be selected for drying of the colored polymeric particles.

The finely divided polymeric particles prepared by processes of the present invention may be optionally treated with surface additives, for example, in amounts from about 0.03 to about 3 weight percent of the total weight of toner to enhance development properties and performance. The surface additives are comprised of fine powders of conductive metal oxides, metal salts, metal salts of fatty acids, colloidal silicas, titanates, quaternary ammonium salts, zwitterionic salts, metal complexes, organometallic complexes, or mixtures thereof.

Other surface additives having charge directing or charge control properties and comprise a mixture of a colloidal silica or titanate, and organoaluminum, organoboron, organozinc, organochromium complexes of a salicylic acid, stearic acid, or catechol.

Charge control additives for regulating the charging properties of the dispersed polymeric particles may be added to the surface of the dry polymeric particles by for example, roll or cone milling, or may be adsorbed on the surfaces of the liquid dispersed particles or dispersed in the liquid suspending medium, for example, in amounts from about 0.03 to about 3 weight percent of the total weight of toner.

Preferred charge control director additives in liquid developers of the present invention typically are inverse micelles used to facilitate particle charging and are comprised of quaternary ammonium salts which are often polymeric in nature, conductive metal oxides, metal and organometallic salt, and the like. Particularly preferred charge director compounds useful in the present invention are comprised of a protonated AB diblock copolymer selected from the group of poly[2-dimethylammonium ethyl methacrylate bromide co-2-ethylhexyl methacrylate], poly[2-dimethylammonium ethyl methacrylate tosylate co-2-ethylhexyl methacrylate], poly[2-dimethylammonium ethyl methacrylate chloride co-2-ethylhexyl methacrylate], poly[2-dimethylammonium ethyl methacrylate bromide co-2-ethylhexyl acrylate], poly [2-dimethylammonium ethyl acrylate bromide co-2-ethylhexyl methacrylate], poly[2-dimethylammonium ethyl acrylate bromide co-2-ethylhexyl acrylate], poly[2-dimethylammonium ethyl methacrylate tosylate co-2-ethylhexyl acrylate], poly[2-dimethylammonium ethyl acrylate tosylate co-2-ethylhexyl acrylate], poly[2-dimethylammonium ethyl methacrylate chloride co-2-ethylhexyl acrylate], and poly[2-dimethylammonium ethyl acrylate chloride co-2-ethylhexyl acrylate], poly[2-dimethylammonium ethyl methacrylate bromide co-N,N-dibutyl methacrylamide], poly[2-dimethylammonium ethyl methacrylate tosylate co-N,N-dibutyl methacrylamide], poly[2-dimethylammonium ethyl methacrylate bromide co-N,N-dibutylacrylamide], poly[2-dimethylammonium ethyl methacrylate tosylate co-N,N-dibutylacrylamide], and the like, and mixtures thereof.

The following examples are being submitted to further define various species of the present invention. These examples are intended to be, illustrative only and are not intended to limit the scope of the present invention. Also, parts and percentages are by weight unless otherwise indicated.

EXAMPLE I

Preparation of Process Feed.

The developer was prepared by dry mixing NUCREL 599® (a copolymer of ethylene and methacrylic acid with a melt index at 190° C. of 500, available from E. I. DuPont de Nemours & Company, Wilmington, Del.), cyan pigment (PV FAST BLUE™) and internal charge additive aluminum stearate (Witco 22™) in the proportions of 75:22:3 respectively, by weight. This blend was then fed into Werner and Pfleiderer ZSK30 twin screw extruder at 10 lb/hr. The extruder barrel temperature profile was 130/130/130/130/130/130/140/150° C. and the screw speed was 300 rpm. The melt temperature was 166° C. The extruded strands were cooled in a water tank, dried and pelletized. These pellets were fed to the extruder again in a second pass at 5 lb/hr. NORPAR 15® (Exxon Corporation) was injected to the upstream port at the #4 barrel section, at approximately 5 lb/hr. The barrel temperature profile was set at 150/180/140/100/100/100/100/100° C. and the screw speed was 150 rpm. The die plate was removed. The extrudate was collected and cooled. The cakes of developer material were cut into strips approximately one by three inches and fed into a shredder (Black & Decker, Handy Slice 'n Shred) to afford thin slivers of material. About 600 g of this material was suspended in about 6 liters of NORPAR and processed in 1 liter batches by a rotor stator mixer (Kinematica® Polytron® probe PTA 45/6) at about 8,000 rpm for about 2 minutes. This material was centrifuged at 4,000 RPM for 20 minutes in a Baxter Cryrofuge Model 6000 centrifuge. After decanting the supernatant, the remaining paste in the bottom of the centrifuge bottle was analyzed by TGA and found to be about 31 weight percent solids. A portion of this material was resuspended in NORPAR and the particle size determined on Horiba CAPA-500 centrifugal automatic particle analyzer. The volume average particle size was found to be 6.44±4.48 microns with over 21% of the particles larger than 8.0 microns.

EXAMPLE II

Supercritical Fluid Toner Particle Comminution.

102 grams of the product of Example I was added to a 1 liter steel sample cylinder (Whitey pn304L-HDF8-1000) reference numeral 25 in FIG. 2. The sample cylinder was sealed by means of valves 32 and 33 and connected to the apparatus of FIG. 2, where the essential elements of the system are shown. The extraction loop, while present, was not used in this Example. With shut off valves 7B, 22A, 31, 32, and 33 in the open position the system was pressurized with carbon dioxide to about 1,500 psi using pump 4 and regulated by balancing valves 5 and 10. The MICROFLUIDIZER® was turned on by applying via a regulator 60 psi air pressure to the pump 27. The maximum pressure between pump 27 and the interaction chamber 28 as measured by gauge 36 was 11,000 psi and remained so throughout the run. The initial temperature was 25° C. at thermocouple 35. Pump 27 labored at first, but after 5 minutes was operating smoothly, the temperature was then 27° C. and the entire system pressure dropped slightly to 1,400 psi. After 8 minutes, the rate of pump 27 improved and remained at an audibly constant rate while pumping throughout the remainder of the run. The temperature at 8 minutes was 30° C. and the entire system pressure rose to 1,600 psi. After 10 minutes the temperature was 33° C. and the system pressure was 1,800 psi and pump 27 was turned off as this pressure was near the limit of vessel 25. Cooling water was started through heat exchanger 30; at 13 minutes the temperature had dropped to 31° C. and the pressure to 1,600 psi. Pump 27 was turned on for 1 minute wherein the temperature rose to 33° C. and system pressure to 1,800 psi. In some instances, the active pressure control may become blocked at in-line filter 20, which can be confirmed by inspection. Processing for an additional 13 minutes using the heat exchanger to keep the temperature in the range of about 21° to 31° C. and the pressure from 1,100 to 1,800 to psi. After a total processing time of about 24 minutes a sample was collected via valve 34. Filter 20 was cleaned after isolating the filter from the system by closing valve 22A. Upon reinstallation of filter 20, valve 22A was opened and the system pressure was released through valves 10 and 11. The total volume of $CO_2$ used was measured by the totalizer 23 was 19.8 cubic feet at room temperature and pressure, or about 1.02 kg. A total of only 0.6 mL of liquid was collected in separator 12 and TGA results showed two samples to be about 29 and 32 weight percent solids indicating very little extraction of the resin by the NORPAR took place during the processing. A portion of the sample taken at valve 34 was resuspended in NORPAR and the particle size determined on Horiba CAPA-500 centrifugal automatic particle analyzer. The volume average particle size was found to be 2.51±1.68 microns with no particles larger than 8.0 microns.

EXAMPLE III

Improved Process Apparatus.

The material of Example II was further processed with an improved configuration of the inlet to the pressure cylinder 25, reference in FIG. 1, in which the return line from the MICROFLUIDIZER® consisting of ⅛ inch stainless steel tubing descends several inches into the cylinder and this configuration avoids particles backing up through the system and plugging filter 20 as was the situation in Example II. The material was processed for 30 minutes at total system pressures between 1,400 and 1,600 psi, the MICROFLUIDIZER® pressure was about 11,500 psi and the temperature rose from 26° C. to 28° C. during the processing. Cooling water flow through the heat exchanger 30 was about 240 mL/min. About 20.8 cu. ft of $CO_2$, corrected to standard temperature and pressure, was exhausted from the system at the end of processing. About 1.7 mL of NORPAR 15 was recovered from the separator 12. The toner was washed out of the pressure cylinder 25 with about 75 mL of NORPAR 15 resulting in an 18.7 weight percent solids suspension. The particles were analyzed on a Horiba CAPA-700 centrifugal automatic particle analyzer and found to have a volume average size of 2.49±1.62 microns. The particle size was essentially unchanged from Example II indicating that sufficient processing had occurred. However, the aforementioned changes in the plumbing configuration provided more reliable processing. The particles were analyzed as a 2 weight percent solids suspension in NORPAR 15 with 0.5 weight percent relative to the solids content of a hydrogen bromide quaternized AB diblock copolymer as a charge director by electroacoustic sonic amplification (ESA) and found to have a zeta potential of −192.4 millivolts and a dynamic mobility of $-1.82\times10^{-10}$ $m^2/V\cdot s$. The particles had a volume average radius of 1.514 microns, and a conductivity of 38 pico mhos.

EXAMPLE IV

Modified Process Apparatus.

The pressure vessel 25 of FIG. 1 and used in Examples II and III was replaced with a 1 liter PARR reactor equipped with a turbine agitator driven through a magnetic coupling by a variable speed electric motor. The orientation of the turbine and direction of rotation was such that it would driving material upwards in the pressure vessel. Also with reference to FIG. 1, filter 26 was removed and the order of the MICROFLUIDIZER® interaction chamber 28 and back pressure module 29 was reversed. The 400 micron back pressure module was now first in series followed by the 75 micron interaction chamber 28, the pump 8 and sight glass 21 were removed as they were not needed. As in Example III, the return line from the heat exchanger 30 descended several inches into the PARR pressure vessel. The processed material consisted of 50 weight percent Superla Mineral Oil from Amoco, 36 weight percent Nucrel 599, 12.5 weight percent Paliotol Yellow D1155, and 1.5 weight percent aluminum stearate that had been hot melt mixed in a Teledyne Readco 2 inch continuous processor, cold ground in a similar processor and passed through a #10 sieve (2.00 mm openings). About 140 g of this material was placed in the 1 liter PARR vessel, the vessel was sealed and pressurized to 1,400 psi and the stirrer run at 500 rpm for about 2 hours to disperse the material in the $CO_2$ prior to passing them through the MICROFLUIDIZER®. The material was processed for 30 minutes with the air supply connected to the MICROFLUIDIZER® pump set at 40 psi. The pressure in the MICROFLUIDIZER® was between 7,000 and 7,500 psi, the temperature at the outlet of vessel 25 dropped from 22° C. to 19° C. during the 30 minutes as there was rapid flow of water through the heat exchanger 30, and the system pressure due to $CO_2$ varied between 1,060 and 1,440, but was for the most part from about 1,220 and to about 1,380 psi. The processed material was recovered by opening vessel 25 and analyzed on a Horiba CAPA-700 particle size distribution analyzer and found to have a area average size of 1.56 microns.

The above mentioned patents and publications are incorporated by reference herein in their entirety.

Other embodiments and modifications of the present invention may occur to those skilled in the art subsequent to a review of the information presented herein; these embodiments and modifications, as well as equivalents thereof, are also included within the scope of this invention.

TABLE

| Components Legend for FIG. 1 |
|---|
| 1. liquid $CO_2$ supply |
| 2. shutoff valve |
| 3. cooling bath (Neslab RTE-110) |
| 4. A & B pumps |
| 5. regulating valve (Haskel pn 53379- |
| 6. pressure gauge |
| 7. A & B shut-off valves |
| 8. gear pump (Micropump pn L3362093) |
| 9. extraction vessel (75 ml) |
| 10. regulating valve (Haskel pn 53379-4) |
| 11. needle valve (AE pn 30VRMM4812-PM) |
| 12. separator vessel |
| 13. relief valve |
| 14. coalescing filter (Balston A944-DX) |
| 15. coalescing filter (Balston A94-BX) |
| 16. carbon filter (Balston pn DAU-000) |
| 17. flow meter (F & P pn 10A35551375-Z) |
| 18. pressure gauge |
| 19. shut-off valve |
| 20. 64μ filter |
| 21. sight gauge |
| 22. A&B valves |
| 23. totalizer (Singer pnDTM-115-1) |
| 24. pressure gauge |
| 25. 1 liter pressure cylinder |
| 26. filter |
| 27. Microfluidizer pump |
| 28. 75 micron interaction chamber |
| 29. 400 micron back pressure module |
| 30. heat exchanger |
| 31 & 32. shutoff valves |
| 33. shut off valve with rupture disc |
| 34. sampling valve |
| 35. thermocouple |
| 36. Microfluidizer pressure gauge |

What is claimed is:

1. A process for preparing a liquid developer composition comprising:

a) forming a melt mixture comprised of a polymer resin or resins, a colorant, a charge director additive, and a hydrocarbon liquid carrier, to obtain a first suspension of colored polymeric particles with an area average diameter of from about 2 to about 100 microns;

b) dispersing said first suspension in a supercritical fluid medium and thereafter continuously feeding the resultant dispersion to a liquid fluidizing means under pressure to obtain a second suspension comprising a supercritical fluid and liquid developer mixture containing colored polymeric particles with an area average diameter of from about 0.1 to about 10 microns; and c) reducing the pressure to evaporate, and optionally recovering, the supercritical fluid medium from said second suspension, wherein there results a liquid developer mixture containing colored polymeric particles with an area average diameter of less than about 3.0 microns and a solids content of about 10 to about 90 weight percent.

2. A process in accordance with claim 1 wherein the polymer resin or resins are selected from the group consisting of polymers and copolymers prepared from free radical reactive or condensation reactive monomers selected from the group consisting of styrene and derivatives thereof, dienes and derivatives thereof, alcohols, diols, bisphenols, monocarboxylic acids and derivatives thereof; dicarboxylic acids and derivatives thereof; vinyl ketones; vinyl ethers; vinyl naphthalene; monoolefins; diolefins; vinylidene halides; N-vinyl compounds; copolymers of ethylene and an α, βethylenically unsaturated acid selected from the group consisting of acrylic acid and methacrylic acid; copolymers of ethylene and acrylic, or methacrylic acid, alkylesters of acrylic and methacrylic acid; and mixtures thereof.

3. A process in accordance with claim 1 wherein the colorant is selected from the group consisting of cyan, yellow, magenta, red, green, blue, brown, orange and black pigments or dyes, and mixtures thereof.

4. A process in accordance with claim 1 wherein the supercritical fluid medium is supercritical or near supercritical carbon dioxide.

5. A process in accordance with claim 1 wherein the hydrocarbon liquid carrier is selected from the group consisting of linear and branched aliphatic hydrocarbons with from about 10 to about 25 carbon atoms and mixtures thereof.

6. A process according to claim 1 further comprising dispersing said melt mixture with high shear or ball milling, and or heating with agitation from about 25° C. to about 150° C., to obtain said first suspension.

7. A process according to claim 6 further comprising cooling said first suspension after melt mixing to about 25° C.

8. A process in accordance with claim 1 wherein the liquid fluidizing means is an opposing stream liquid jet interaction chamber.

9. A process in accordance with claim 1 wherein the liquid fluidizing means is a piston homogenizer.

10. A process in accordance with claim 1 wherein the dispersion is resident in the liquid fluidizing means for about 1 second to about 40 minutes.

11. A process in accordance with claim 4 wherein the polymer resin or resins and colored polymeric particles are substantially insoluble in the supercritical or near supercritical fluid medium, hydrocarbon liquid carrier, and mixtures thereof.

12. A process in accordance with claim 1 wherein the weight percent solids of the first suspension, the supercritical fluid medium second suspension, and the resultant liquid developer mixture are substantially the same.

13. A process in accordance with claim 1 conducted at a temperature of less than about 60° C.

14. A process in accordance with claim 1 conducted at a temperature of about 20° to about 50° C.

15. A process in accordance with claim 1 wherein the colored polymeric particles obtained from step (b) have an area average particle diameter of from about 1.0 micron to about 5.0 microns.

16. A process in accordance with claim 1 wherein the colored polymeric particles of the liquid developer obtained have a geometric particle size distribution (GSD) of less than about 1.2 to about 1.8.

17. A process in accordance with claim 1 wherein the polymer resin has a number ($M_n$) and weight ($M_w$) average molecular weight of from about 5,000 to about 500,000 and about 10,000 to about 2,000,000, respectively.

18. A process in accordance with claim 1 wherein the number ($M_n$) and weight average ($M_w$) molecular weight of the polymer resin is from about 5,000 to about 50,000 and about 10,000 to about 100,000, respectively, and a polydispersity of between about 1 and about 15.

19. A liquid developer obtained by the process of claim 1 comprising a polymer resin or resins, a colorant, a charge director, and a hydrocarbon liquid carrier wherein the resulting colored polymeric particles have an area average diameter of from about 1 to about 4 micrometers.

20. A liquid developer according to claim 19 wherein the polymeric resin or resins comprises from about 70 to about 98 percent by weight of the solids content of the developer, the colorant comprises from about 1 to about 30 percent by weight of the solids content of the developer, and the charge director comprises from about 0.1 to about 15 percent by weight of the solids content of the developer.

21. A liquid developer according to claim 19 wherein the hydrocarbon liquid carrier is present from about 50 to about 90 of the total weight of the developer.

22. A liquid developer according to claim 19 further comprising adding to the surfaces of the finely divided suspended colored polymeric particles or to the melt mixture, charge control additives comprising fine powders of conductive metal oxides, metal salts, metal salts of fatty acids, colloidal silicas, titanates, quaternary ammonium salts, metal complexes, organometallic complexes, or mixtures thereof.

23. A liquid developer according to claim 22 wherein the charge control additives are selected from the group consisting of a mixture of a colloidal silica or titanate, and an organoaluminum, organoboron, organozinc, or organochromium complex of a salicylic acid or catechol, and wherein said charge additives are added to the bulk of the polymer in said melt mixture.

24. A liquid developer according to claim 23 further comprising adding a charge director additive to the hydrocarbon liquid carrier continuous phase for regulating the charging properties of the dispersed colored polymeric particles.

25. A liquid developer according to claim 24 wherein the charge director additives are quaternary ammonium salt functional groups appended to block copolymers.

26. A developer according to claim 25 further comprising removing the hydrocarbon liquid carrier to afford a dry free flowing powder which is suitable for use as a dry developer.

27. A liquid developer according to claim 24 wherein the colored particles at about 2 weight percent solids have a volume average radius of about 1.0 to about 2.0 microns, a conductivity of about 30 to about 40 pico mhos, and a dynamic mobility of about $-1.0\times10^{-10}$ to about $-2.0\times10^{-10}$ $m^2/V\cdot s$.

28. A process in accordance with claim 1 wherein the pressure is from about 800 to about 4,000 psi, and the area average particle diameter of the liquid developer colored particles is less than about 2.0 microns.

* * * * *